US009314842B2

(12) United States Patent
Micklash, II et al.

(10) Patent No.: US 9,314,842 B2
(45) Date of Patent: Apr. 19, 2016

(54) HOT PRESSING APPARATUS AND METHOD FOR SAME

(71) Applicant: Wildcat Discovery Technologies, San Diego, CA (US)

(72) Inventors: Kenneth James Micklash, II, Carmel, IN (US); Mark S. Bailey, Palo Alto, CA (US)

(73) Assignee: Wildcat Discovery Technologies, Inc., San Diego, CA (US)

( * ) Notice: Subject to any disclaimer, the term of this patent is extended or adjusted under 35 U.S.C. 154(b) by 607 days.

(21) Appl. No.: 13/687,521

(22) Filed: Nov. 28, 2012

(65) Prior Publication Data

US 2013/0140740 A1 Jun. 6, 2013

Related U.S. Application Data

(60) Provisional application No. 61/566,037, filed on Dec. 2, 2011.

(51) Int. Cl.

| | |
|---|---|
| ***B22F 3/14*** | (2006.01) |
| ***B22F 3/00*** | (2006.01) |
| ***B22F 3/03*** | (2006.01) |
| ***B30B 15/34*** | (2006.01) |
| ***B30B 11/02*** | (2006.01) |
| ***B30B 15/04*** | (2006.01) |
| ***B30B 15/06*** | (2006.01) |

(52) U.S. Cl.

CPC . *B22F 3/00* (2013.01); *B22F 3/004* (2013.01); *B22F 3/03* (2013.01); *B22F 3/14* (2013.01); *B30B 11/027* (2013.01); *B30B 15/041* (2013.01); *B30B 15/067* (2013.01); *B30B 15/34* (2013.01); *B22F 2003/033* (2013.01); *B22F 2003/145* (2013.01)

(58) Field of Classification Search

CPC ..... B22F 3/14; B22F 3/03; B22F 3/004; B22F 2003/033; B22F 2003/145

See application file for complete search history.

(56) References Cited

U.S. PATENT DOCUMENTS

| | | | | |
|---|---|---|---|---|
| 3,694,127 | A * | 9/1972 | Takahashi | B22F 5/08 29/893.3 |
| 3,890,413 | A * | 6/1975 | Peterson | B30B 15/067 264/297.9 |
| 3,986,803 | A * | 10/1976 | MacNitt, Jr. | B22F 3/14 425/123 |
| 4,184,827 | A * | 1/1980 | von Herrmann | B30B 11/005 250/237 G |
| 4,298,563 | A * | 11/1981 | DeSantis | B22F 3/03 419/38 |
| 5,093,076 | A * | 3/1992 | Young | B22F 3/02 148/101 |
| 5,985,207 | A * | 11/1999 | Vawter | B22F 3/1283 419/25 |
| 5,993,734 | A * | 11/1999 | Snowman | B22F 3/14 419/48 |
| 7,111,802 | B2 * | 9/2006 | Lugmair | B01J 19/0046 241/149 |

(Continued)

FOREIGN PATENT DOCUMENTS

DE EP 1125716 A2 * 8/2001 ..... B22F 3/14

*Primary Examiner* — Mark A Osele

(74) *Attorney, Agent, or Firm* — Quinn Law Group, PLLC

(57) ABSTRACT

An apparatus for parallel hot pressing includes a die assembly that defines multiple pockets, as well as a load transferring mechanism selectively providing a respective uniaxial compressive load at each of the pockets. Multiple heating mechanisms are arranged so that each of the pockets is aligned with a different respective one of the heating mechanisms, the load transferring mechanism and the heating mechanisms thereby providing both compressive loading and heating of multiple material samples in parallel when material samples are placed in the pockets. A method of hot pressing in parallel is also provided.

8 Claims, 10 Drawing Sheets

(56) References Cited

U.S. PATENT DOCUMENTS 7,150,617 B1 * 12/2006 Lowell ..... B29C 43/361 100/269.01
7,351,048 B2 * 4/2008 Hinzpeter ..... B22F 3/03 425/149
8,392,921 B2 * 3/2013 Song ..... G06F 9/5038 700/245
2006/0008376 A1 * 1/2006 Olsson ..... B22F 3/087 419/66
2006/0022371 A1 * 2/2006 Nakai ..... B22F 3/02 264/109
2007/0269334 A1 * 11/2007 Lawcock ..... B22F 3/04 419/68
2009/0291012 A1 * 11/2009 Okahara ..... B22F 3/087 419/31

* cited by examiner

HOT PRESSING APPARATUS AND METHOD FOR SAME

CROSS-REFERENCE TO RELATED APPLICATION

U.S. Provisional Application No. 61/566,037 filed on Dec. 2, 2011 is hereby incorporated by reference in its entirety.

TECHNICAL FIELD

The invention relates to an apparatus for pressing and heating multiple material samples in parallel and a method for same.

BACKGROUND

Material pellets are used for research in a wide range of technologies. For example, in semiconductor and thermoelectrics technologies, knowledge of the transport characteristics of a material, including its electrical resistivity (DC and AC), Hall coefficient, thermal conductivity and thermopower is required. In addition, in the area of structural materials, accurate information regarding a sample's toughness, yield strength, and hardness is often required. In the powder metallurgy field, reliable information on material properties can be obtained from a highly dense pellet (e.g., a pellet having greater than 99% density and less than 1% air pockets). Furthermore, pellets of materials are often used to obtain greater understanding of a material through optical measurements such as ultraviolet-visible (UV-Vis), infrared (IR) or magnetization measurements. Pellets are used in a wide variety of applications. In any given application, there may be many different material types to be researched, each of which has a myriad of chemical and processing variations.

Powdered material is often used as a starting form for making components of complex shapes. Powdered material is transformed into a dense, solid body through the application of pressure and/or heat. The general method for creating a dense body begins with loading loose powder into a die. The powder can be a metal, a ceramic, a plastic or any other material that is to be compressed. Pressure is applied to the powder through loading of an upper and lower punch. This pressure is high enough to cause the powdered material to fuse and take the shape of the interior of the die. If the load is taken off, the part can be removed from the die as a solid body. In this green state, the powder is usually not fully dense, the part lacks cohesion and is either very brittle or remains powdery. A green body is converted into a dense body by consolidation, a process that removes voids from the pellet, thus increasing the density. Consolidation requires mass transport within the green body, a process that can be activated by heat (sintering), ultra-high pressure, and/or the application of a voltage between the punches (e.g., Spark Plasma Sintering).

Spark Plasma Sintering (SPS) achieves consolidation through the application of a potential difference between the upper and lower punches. Advantages to this process include the reduction of sintering time and, as a consequence, the ability to retain the nanostructured grain structure necessary in many applications. The process of SPS is achieved by application of a potential difference (~5 Volts, for example) between the punches and the generation of very high currents (>1000 Amps, for example). These currents are thought to induce consolidation by generation of heat via Joule heating and through the generation of plasma within the powder material.

Uniaxial hot pressing is used to densify a loose powder into a solid body, such as a pellet, that will be tested to determine different properties of the densified material. A load is applied to a powder (held in a die) in one direction, thus compacting the powder. At the same time, heat is applied to the powder in order to sinter it and bring the bulk component close to 100% material density. Traditional uniaxial hot pressing methods process one material sample at a time. In a lab where a large number of material samples are required for testing, this is too slow and expensive.

SUMMARY

Access to a high-throughput pellet press would greatly increase the rate of production of material sample pellets and subsequent material research. An apparatus is provided that performs uniaxial hot pressing to multiple powder material samples in parallel. As used herein, "in parallel" means that load and/or heat is applied to the multiple powder material samples simultaneously. In some embodiments, the apparatus applies independent levels of loading and/or heat to the multiple powder samples. Parallel uniaxial hot pressing by the apparatus allows many samples to be densified in a high throughput manner.

Specifically, the apparatus includes a die assembly that defines multiple pockets, as well as a load transferring mechanism selectively providing a respective uniaxial compressive load at each of the pockets. Multiple heating mechanisms are arranged so that each of the pockets is aligned with a different respective one of the heating mechanisms. The load transferring mechanism and the heating mechanisms provide both compressive loading and heating of multiple material samples in parallel when material samples are placed in the pockets. The heating mechanisms may include inductive heating coils. Alternatively, the heating mechanisms may include lead wires, a power source and a power circuit configured to create a potential voltage difference between the upper and lower punches.

A method of hot pressing material includes dispensing powder material samples into spaced pockets at least partially defined by a die assembly and applying uniaxial pressure to each of the powder material samples in the spaced pockets with a load transferring mechanism to compact the powder material samples in parallel. Heating mechanisms are activated to heat the powder material samples in parallel while the uniaxial pressure is applied by the load transferring mechanism.

The above features and advantages and other features and advantages of the present invention are readily apparent from the following detailed description of the best modes for carrying out the invention when taken in connection with the accompanying drawings.

DETAILED DESCRIPTION

Figure 1:
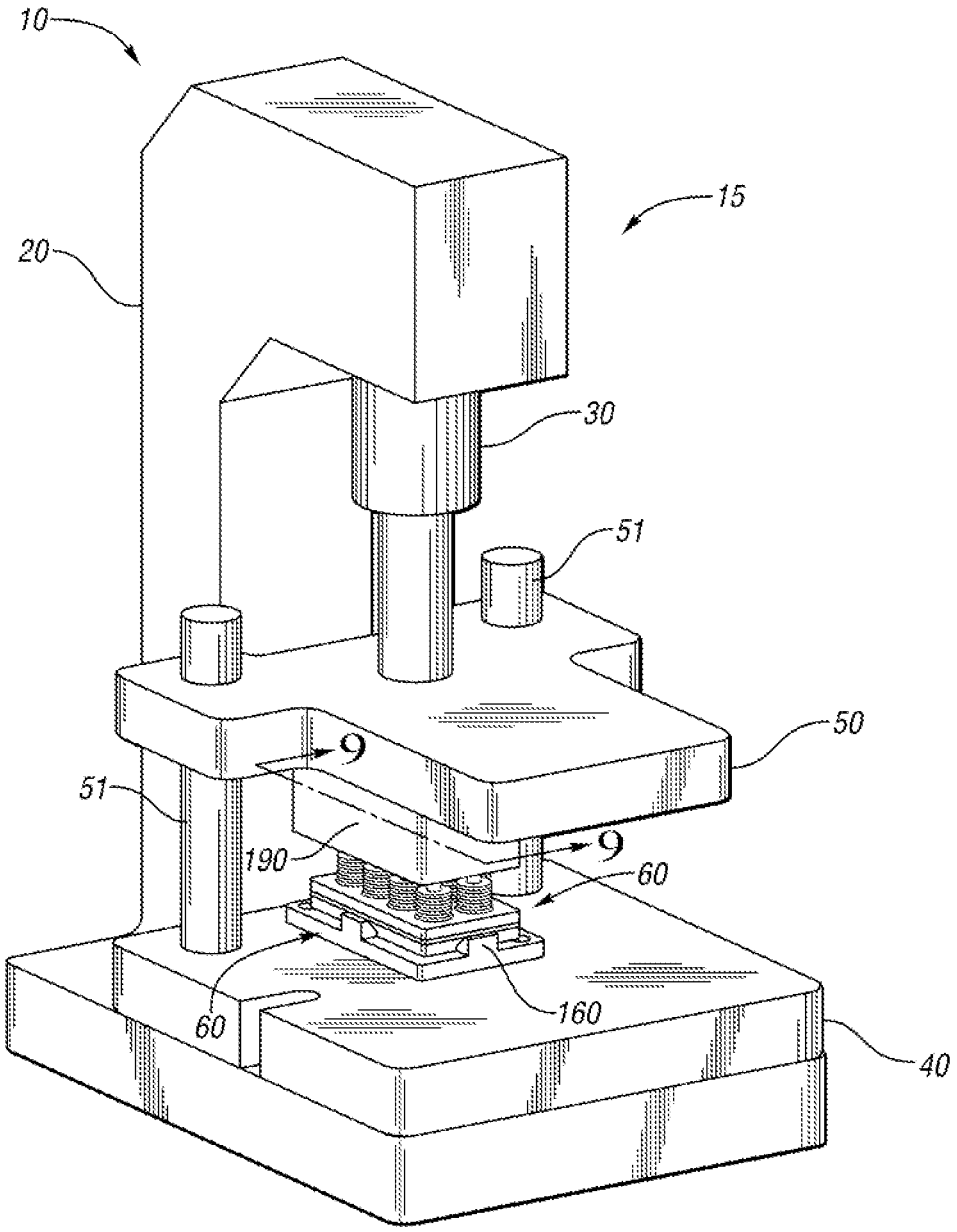
FIG. 1 is a schematic illustration in perspective view of an apparatus (in a closed position) for parallel uniaxial hot pressing.

Referring to the drawings, wherein like reference numbers refer to like components throughout the views, FIG. 1 shows a perspective view of an apparatus 10 for parallel uniaxial hot pressing. In this embodiment, the apparatus 10 includes a load transferring mechanism 15 that includes a press 20 and a hydraulic cylinder 30 that acts on the press 20. A die set made up of a lower die plate 40 and an upper die plate 50 is included to ensure that all load from the press 20 is transmitted in one axial direction to powder material samples to be compressed.

Figure 2:
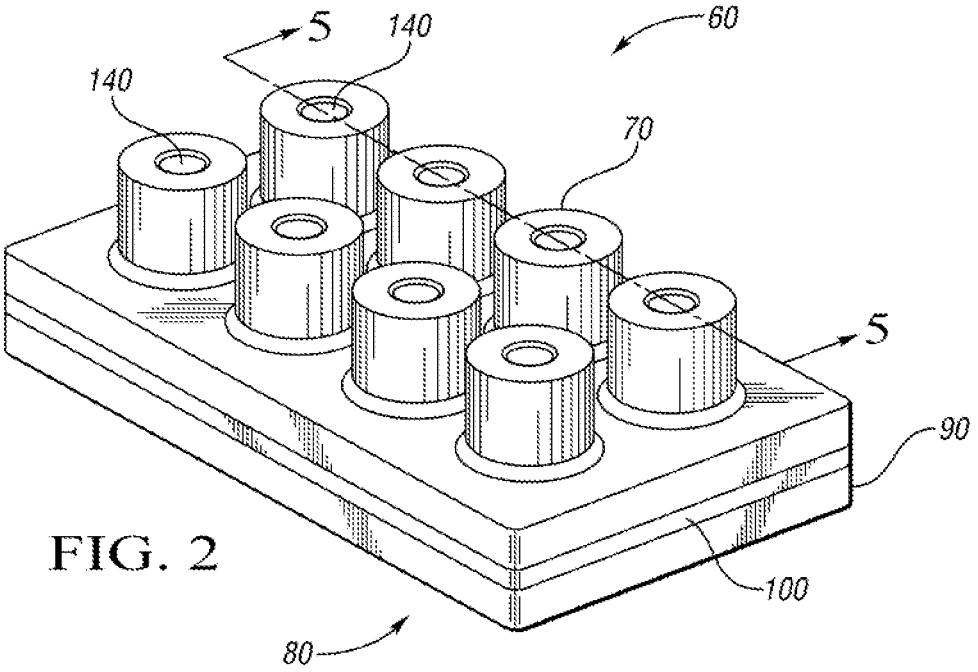
FIG. 2 is a schematic illustration in perspective view of a parallel die assembly with a parallel lower punch assembly both of which are included in the apparatus of FIG. 1.
Figure 3:
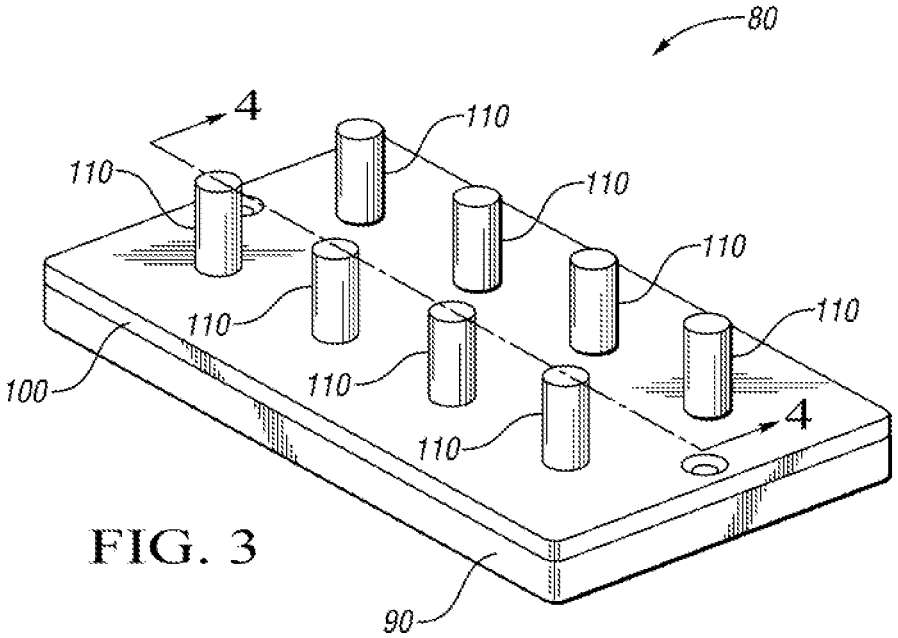
FIG. 3 is a schematic illustration in perspective view of the parallel lower punch assembly of FIG. 2.

The apparatus includes a parallel die assembly 60 that is shown in more detail in FIG. 2. The parallel die assembly 60 includes a parallel die 70 and a parallel lower punch assembly 80. An isometric view of the parallel lower punch assembly 80 is shown in FIG. 3. The parallel lower punch assembly 80 has a punch support plate 90, a punch retaining plate 100, and a number of lower punches 110. The embodiment shown has eight lower punches 110. The number of lower punches 110 can be increased to match the throughput needs of a given laboratory. That is, more material samples can be processed in parallel by providing a lower punch assembly that has a greater number of lower punches.

Figure 4:
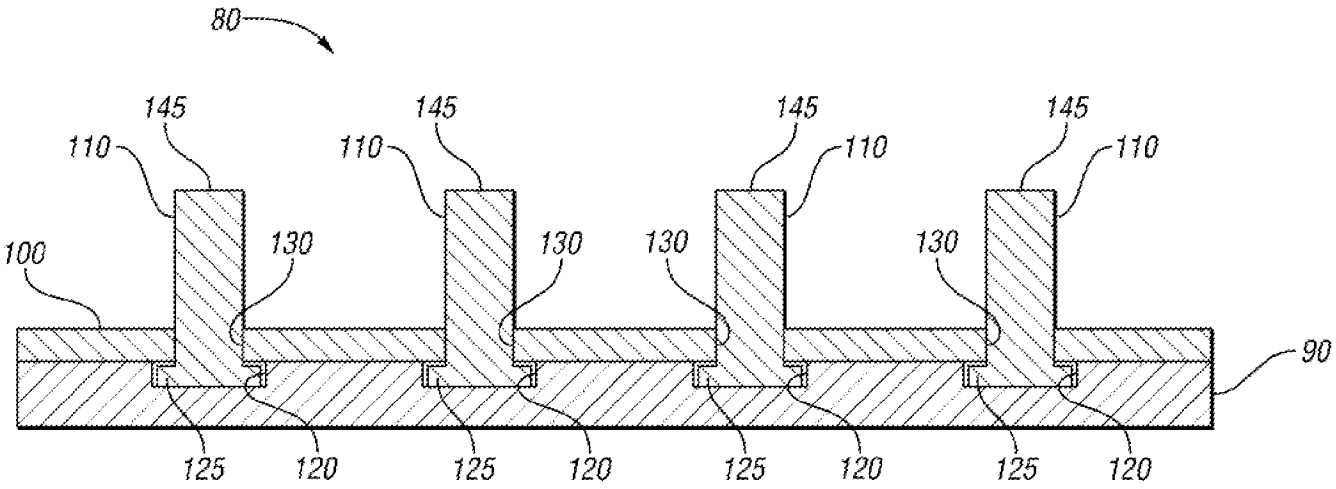
FIG. 4 is a schematic cross-sectional illustration of the parallel lower punch assembly taken at arrows 4-4 in FIG. 3.

FIG. 4 shows a cross-sectional view of the parallel lower punch assembly 80 taken at lines 4-4 in FIG. 3, through the centerline of one row of lower punches 110. Spaced recesses 120 are cut or formed in the punch support plate 90 so that there is one recess 120 for each lower punch 110 in the parallel lower punch assembly 80. When the punch retaining plate 100 is attached to the parallel lower punch assembly 80, the lower punches 110 are trapped and cannot fall out of the recesses 120 because head portions 125 of the lower punches 110 are larger than pass-through openings 130 in the retaining plate 100. The size of each of the pass-through openings 130 in the retaining plate 100 is slightly larger than the size of a body portion 145 of the corresponding lower punch 110. This allows the lower punches 110 to move independently of one another, ensuring proper alignment when the parallel die 70 is assembled to the parallel lower punch assembly 80 as in FIG. 5.

Figure 11:
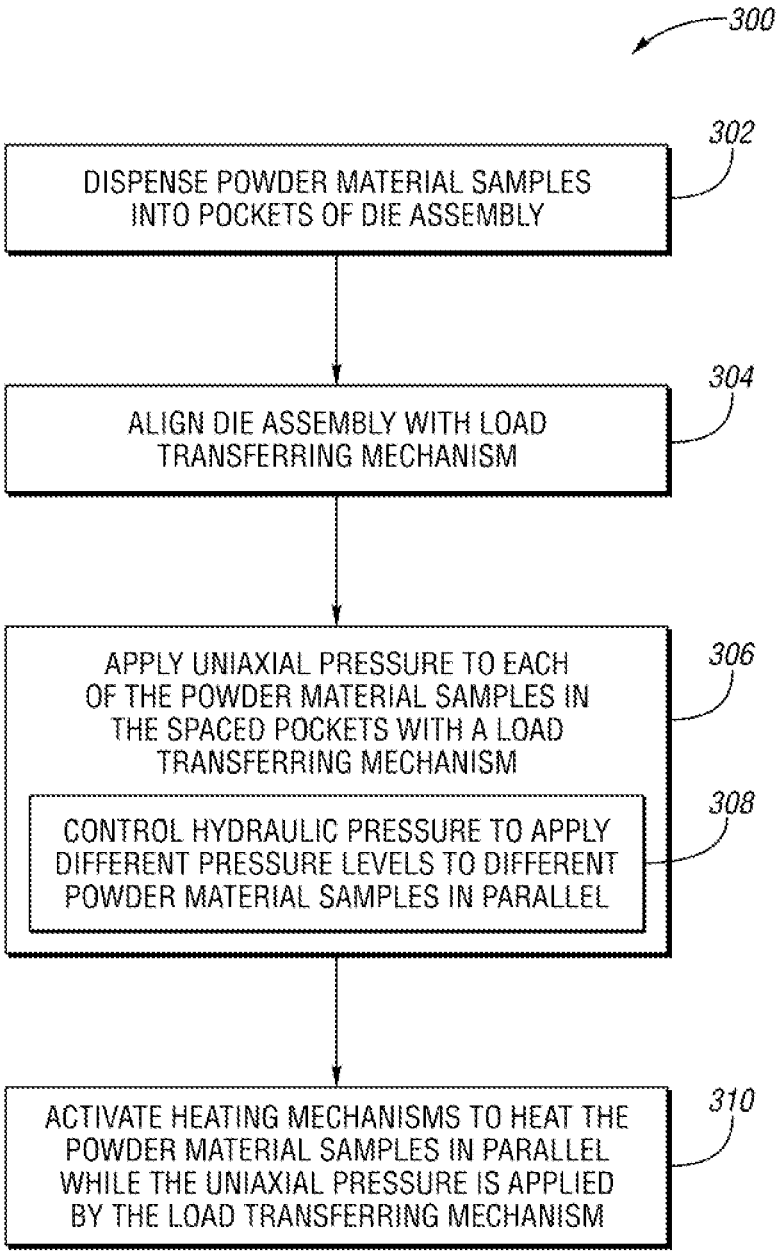
FIG. 11 is a flow diagram illustrating a method of uniaxial hot pressing multiple material samples in parallel.

FIG. 11 illustrates a method 300 of parallel hot pressing, which is a process for making solid bodies from raw powder. The method 300 begins with step 302 by dispensing powdered material samples into the parallel die assembly 70 as in FIG. 5. Powder material samples 150A, 150B, 150C, 150D are poured or otherwise dispensed into spaced pockets 135 defined by the assembled lower punches 110 and the corresponding openings 140 in the parallel die 70. Each pocket 135 can be filled with a different powder material sample 150A, 150B, 150C, 150D to create a large number of samples of different materials for testing or with the same powder material to create a large number of samples of the same initial powder material.

Four additional pockets 135 are formed by the parallel die 70 above the other four lower punches 110, and may be filled with the same or with different powder material samples. The pockets 135 shown in this embodiment have a circular cross-section. However, the pockets 135 could have any cross-sectional shape resulting from the lower punches 110 and die 70, with the lower punch 110 configured to fit into the opening 140 (that is, the lower punch 110 and the opening 140 having complementary shapes). In this embodiment, each lower punch 110 has a flat surface 142 on which the respective material sample 150A-150D rests. Alternatively, the surface 142 could have other topography as required by the part to be pressed. For example, the surface of a pocket 135 on which the powder material sample rests could instead be a three-dimensional shape in order to impart a corresponding three-dimensional shape to an outer surface of the processed material sample.

Figure 6:
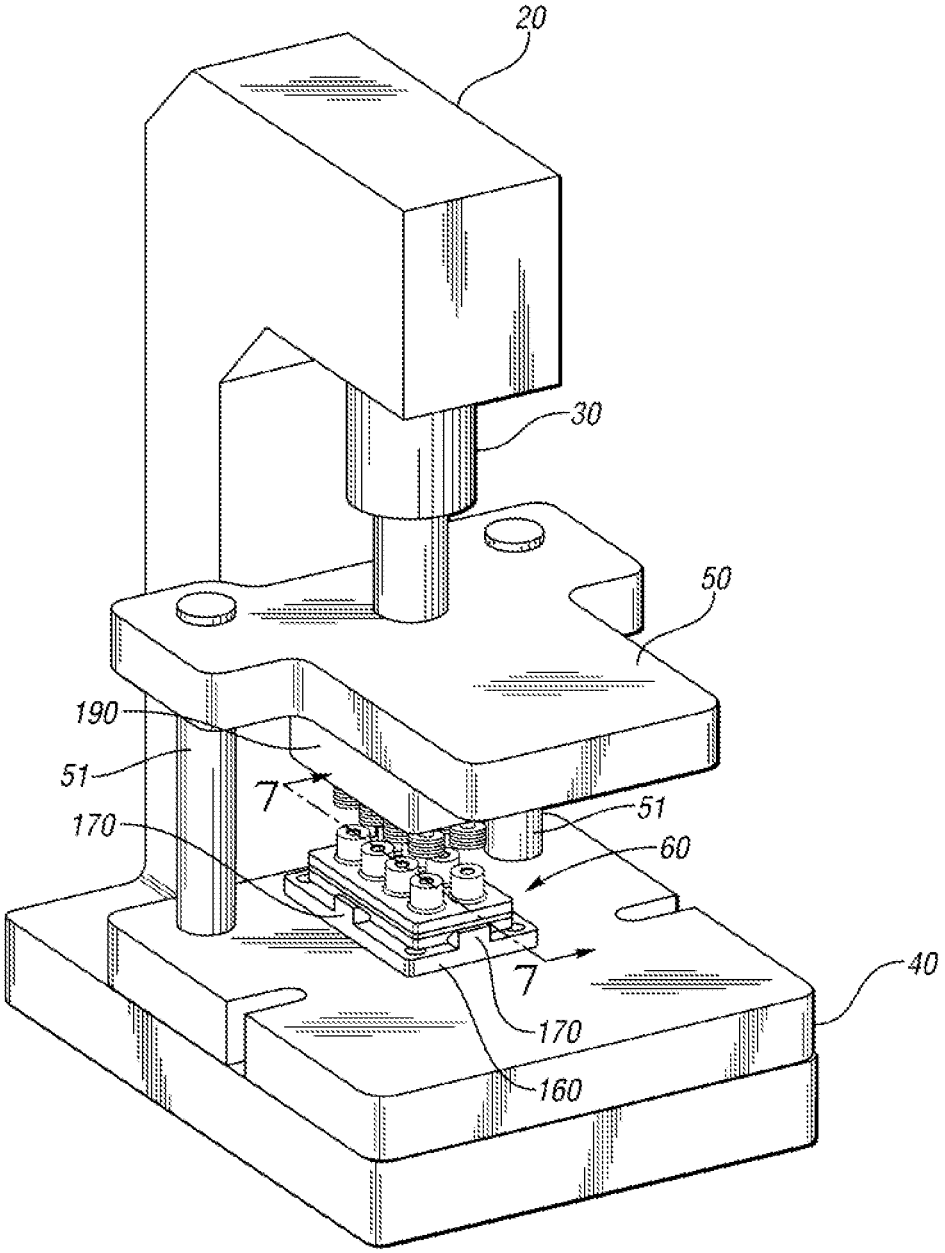
FIG. 6 is a schematic illustration in perspective view of the apparatus of FIG. 1 in an open position.
Figure 7:
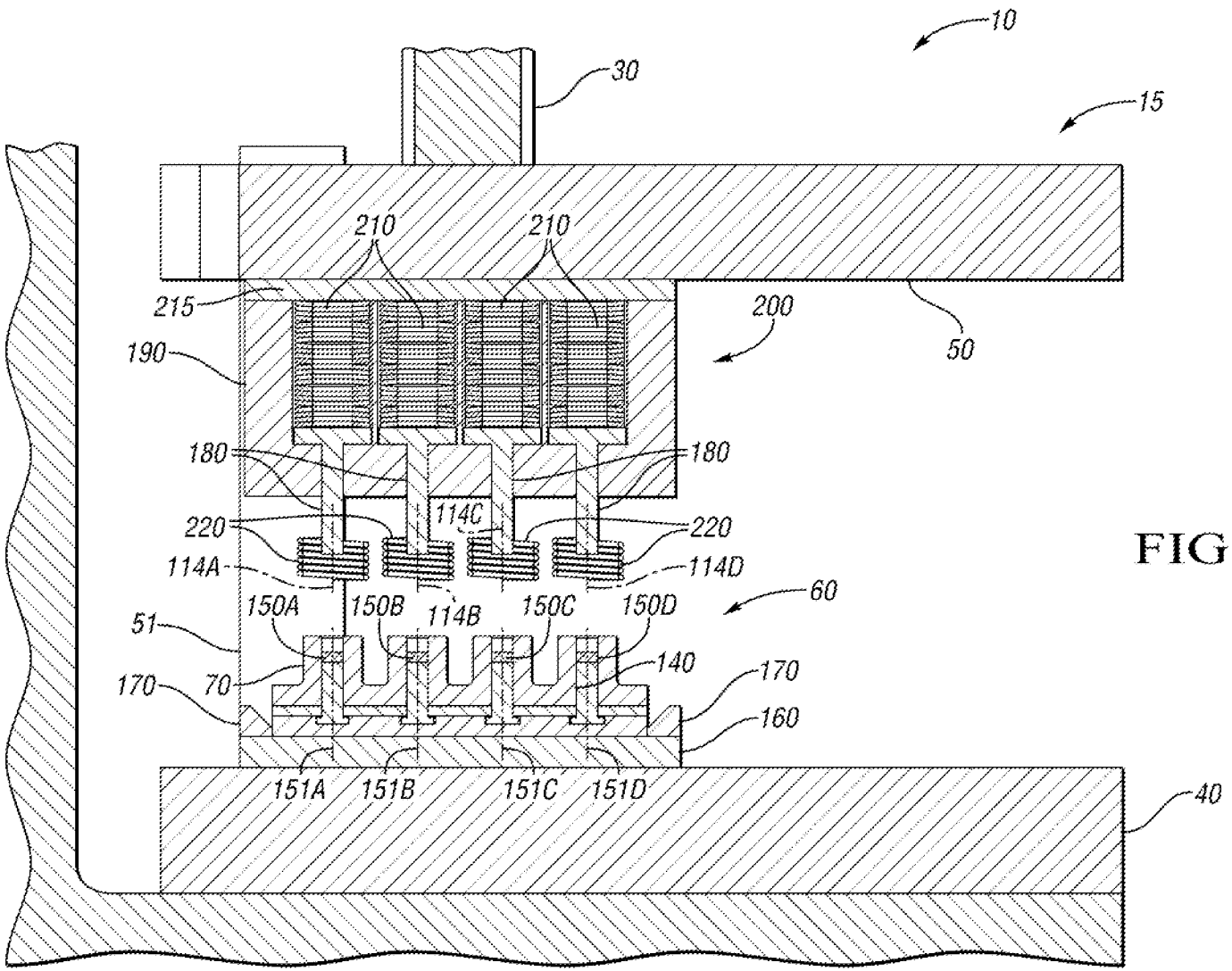
FIG. 7 is a schematic cross-sectional illustration of the apparatus of FIG. 6 taken at arrows 7-7 in FIG. 6 showing heating coils used for inductive heating of the material samples.

In step 304 of the method 300 of FIG. 11, the pockets 135 containing the powder material samples 150A, 150B, 150C, 150D are aligned with the load transfer mechanism 15 by positioning the parallel die assembly 60 on a nest plate 160 as shown in FIG. 6. The press 20 of the apparatus 10 is placed in an open position for loading and unloading the parallel die assembly 60. In the open position, the upper punch housing 190 and upper punches 180 shown in FIG. 7 are spaced from the material samples 150A, 150B, 150C, 150D in the pockets 135 of the die assembly 60. The parallel die assembly 60 is positioned on the nest plate 160 in a location determined by one or more locating features. In the embodiment of FIG. 7, the locating features are tabs 170. The parallel die assembly 60 is located in a position by the tabs 170 so that the centerline 151A, 151B, 151C, 151D of each opening 140 of the die 70 is substantially aligned with the centerline 114A, 114B, 114C, 114D of the corresponding upper punch 180, as best shown in FIG. 7. The upper punches 180 are assembled into the parallel punch housing 190 which is part of a parallel upper punch assembly 200. The punch housing 190 is secured to a backing plate 215 which is secured to the upper die 50. The punch housing 190 and the backing plate 215 are secured to one another and to the upper die 50 by any suitable means, such as by fasteners that extend through aligned fastener openings in the backing plate 215, in the punch housing 190, and in the upper die 50 (none of which are visible in the cross-sectional view of FIG. 7).

Figure 9:
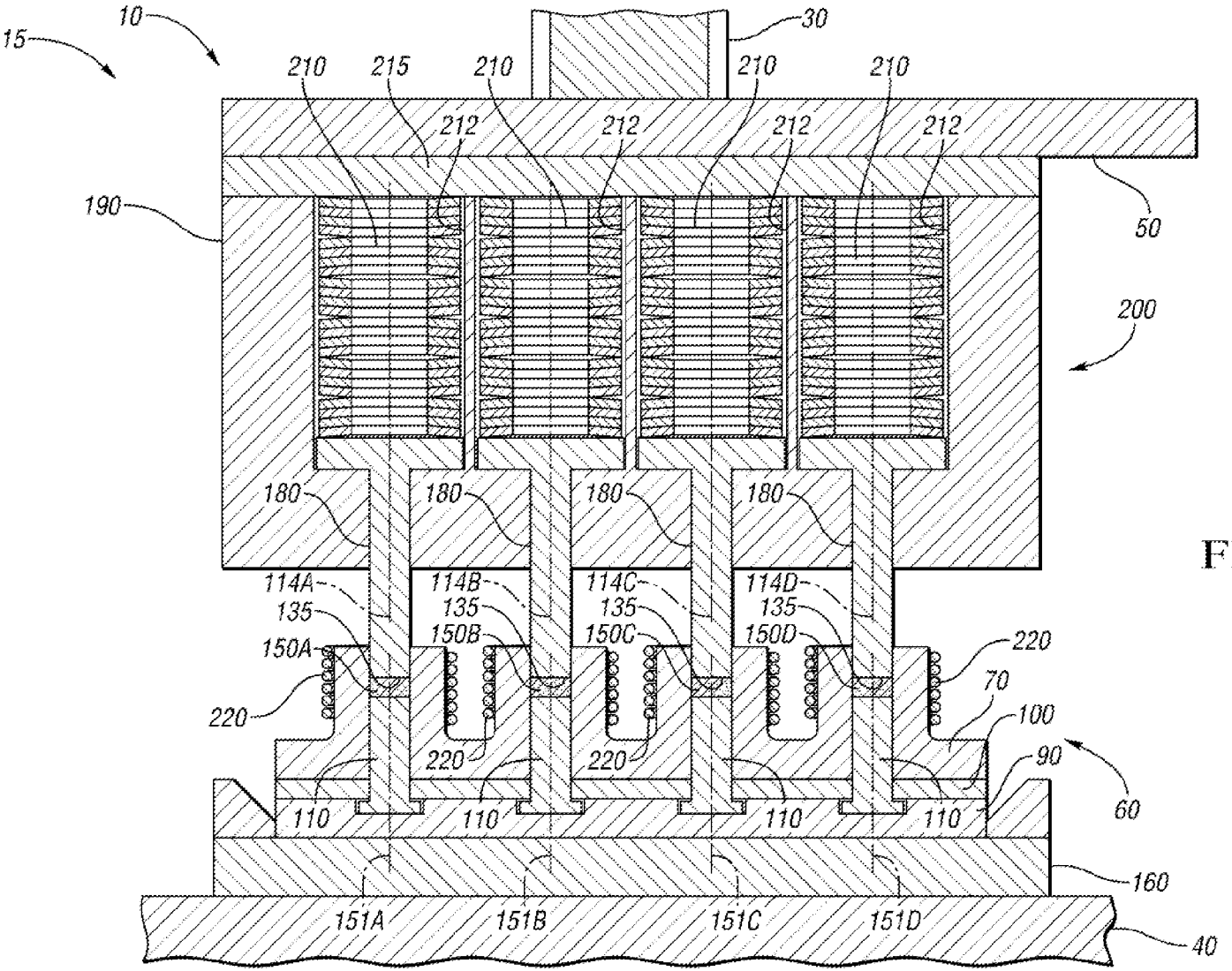
FIG. 9 is a schematic cross-sectional illustration of the apparatus taken at arrows 9-9 in FIG. 1.

Once the parallel die assembly 60 is loaded on the nest plate 160, the powder material samples 150A, 150B, 150C, 150D can be compacted. In step 306, uniaxial pressure is applied to each of the powder material samples 150A, 150B, 150C, 150D by pressurizing the hydraulic cylinder 30. That is, a hydraulic fluid is directed from a hydraulic fluid supply to the cylinder 30. The cylinder 30 has telescoping portions that expand the cylinder 30 when pressurized with the fluid. This causes the upper die plate 50 to move toward the powder material samples 150A, 150B, 150C, 150D (i.e., down in FIG. 7) along guide posts 51 until the upper punches 180 come into contact with the powder material samples 150A, 150B, 150C, 150D, as shown in FIG. 9. Load from the hydraulic cylinder 30 is applied to each upper punch 180 through respective biasing mechanisms, which in this embodiment are separate stacks of wave springs 210. One stack of wave springs 210 is positioned above each upper punch 180. Each stack of wave springs 210 is in a respective bore 212 in the parallel punch housing 190. Wave springs are beneficial as they can be configured to provide a high resistance to compression, enabling a high load to be created in a relatively small axial space. The stacks of wave springs 210 are held into position by the backing plate 215. The backing plate 215 can be attached to the housing 190 with fasteners, as discussed above, so that the backing plate 215 moves with the housing 190. If space allows, other types of springs can be used instead of wave springs.

The hydraulic cylinder 30 travels until the stacks of wave springs 210 are compressed a desired amount. Once the upper punches 180 contact the material samples 150A, 150B, 150C, 150D, the compressive load is transferred from the cylinder 30 through the upper die plate 50, the backing plate 215, and the stacks of wave springs 210 to the upper punches 180 and the powder material samples 150A, 150B, 150C, 150D along the respective centerlines 114A, 114B, 114C, 114D of the upper punches 180.

Each upper punch 180 is thus loaded by an individual stack of wave springs 210. This allows each upper punch 180 to move axially, independently of the other upper punches 180. Independent loading of the upper punches 180 allows each powder material sample 150A, 150B, 150C, 150D to be compressed a different desired amount. If the upper punches 180 were not independent, the loading of each powder material sample 150A, 150B, 150C, 150D would vary depending on the amount of material sample in each pocket 135. For example, if one pocket 135 contained a material sample of much less volume than the others, the upper punch 180 corresponding with that pocket 135 would not come into contact with the material sample. By enabling the upper punches 180 to move independently of one another, a desired load can be transferred to each powder material sample 150A, 150B, 150C, 150D.

The load transferring mechanism 15 shown uses similar stacks of wave springs 210 for each upper punch 180, thus providing the same loading on each powder material sample 150A, 150B, 150C, 150D. Different loads at one or more of the powder material samples 150A, 150B, 150C, 150D can be achieved by using different stiffness springs for each stack of wave springs 210 at each upper punch 180. In this way, different pressures can be applied in parallel to the different powder material samples 150A, 150B, 150C, 150D. A first powder material sample, such as material sample 150A in a first pocket 135 can be subjected to a different compressive load than a second powder material sample 150B in a second of the pockets 135.

Figure 10:
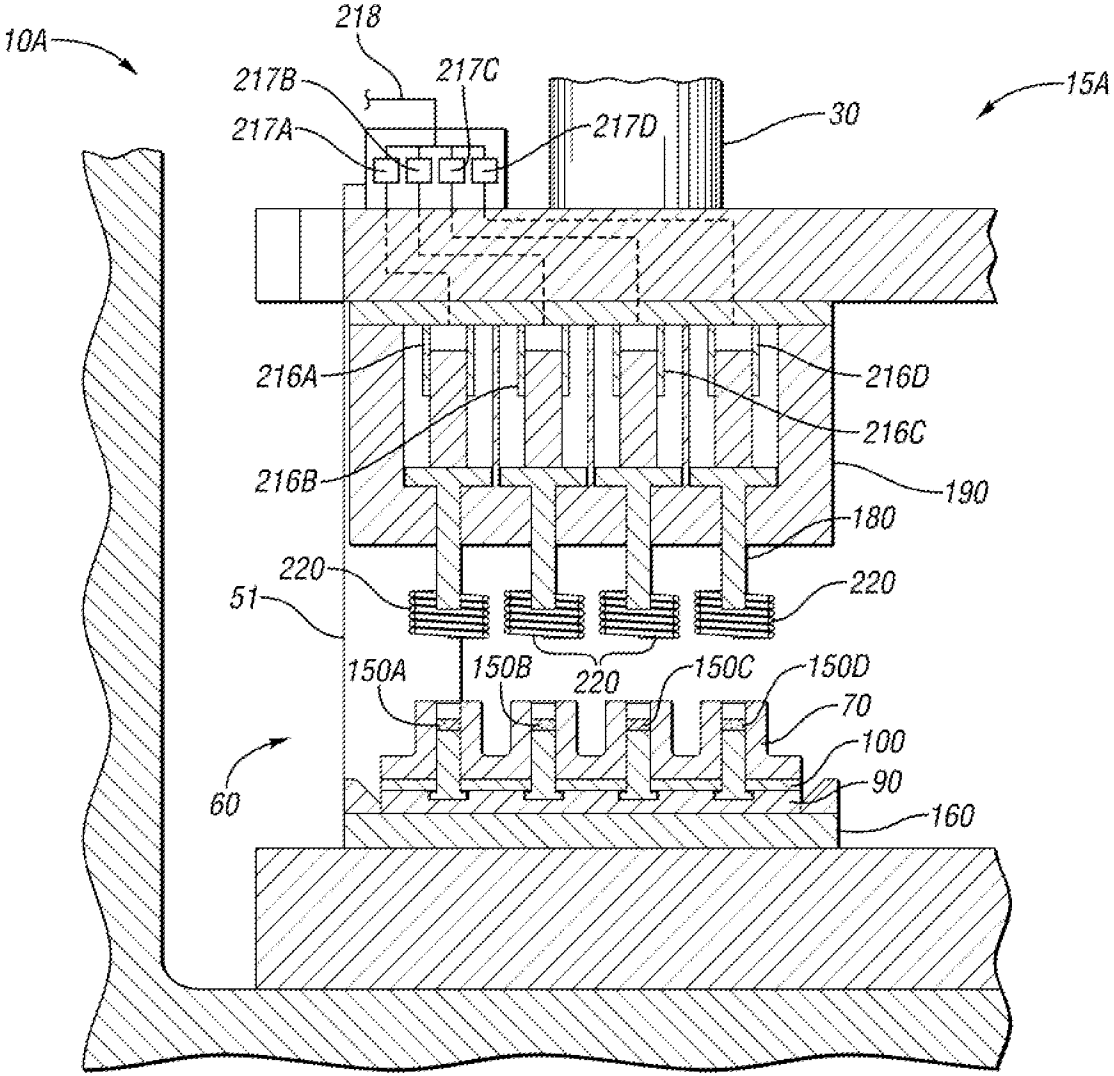
FIG. 10 is a schematic cross-sectional illustration of an alternative embodiment of an apparatus for parallel uniaxial hot pressing with multiple hydraulic cylinders having individual hydraulic control.

An alternate embodiment of a uniaxial parallel hot pressing apparatus 10A is shown in FIG. 10. The apparatus 10A has many of the same components as the apparatus 10, except that a load transferring mechanism 15A includes multiple biasing mechanisms that are individual hydraulic cylinders 216A, 216B, 216C, 216D rather than stacks of wave springs 210. Hydraulic cylinders can enable greater control over a load that is applied to a powder material sample than when a load is applied through a stack of wave springs. Each cylinder 216A, 216B, 216C, 216D can be pressurized independently by controlling valves 217A, 217B, 217C, 217D in a valve body 218 to more precisely provide different pressures of hydraulic fluid to each cylinder 216A, 216B, 216C, 216D, and corresponding different loads as required for the respective powder material samples 150A, 150B, 150C, 150D. The hydraulic load can also be adjusted during the pressing process if desired. When the method 300 is carried out using the apparatus 10A, step 306 includes sub-step 308, controlling hydraulic pressure applied by the load transferring mechanism 15A such that different pressure levels are applied to different ones of the cylinders 216A, 216B, 216C, 216D, resulting in different loads at the respective material samples 150A, 150B, 150C, 150D.

Figure 5:
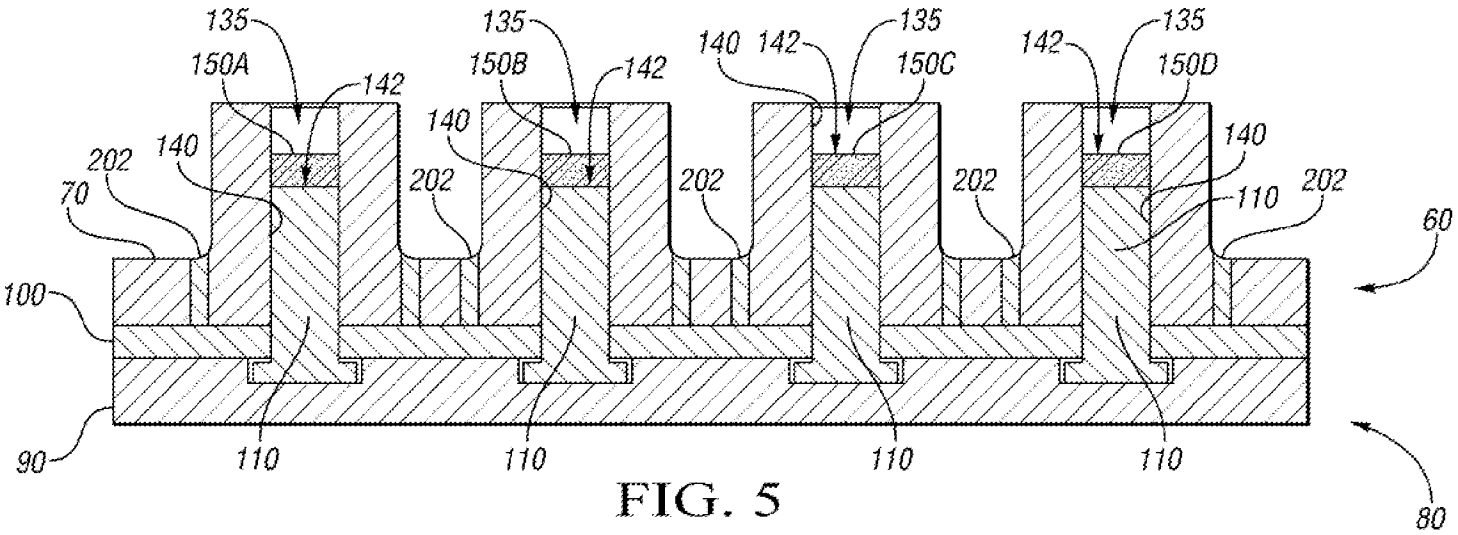
FIG. 5 is a schematic cross-sectional illustration of the parallel die assembly taken at arrows 5-5 in FIG. 2.
Figure 8:
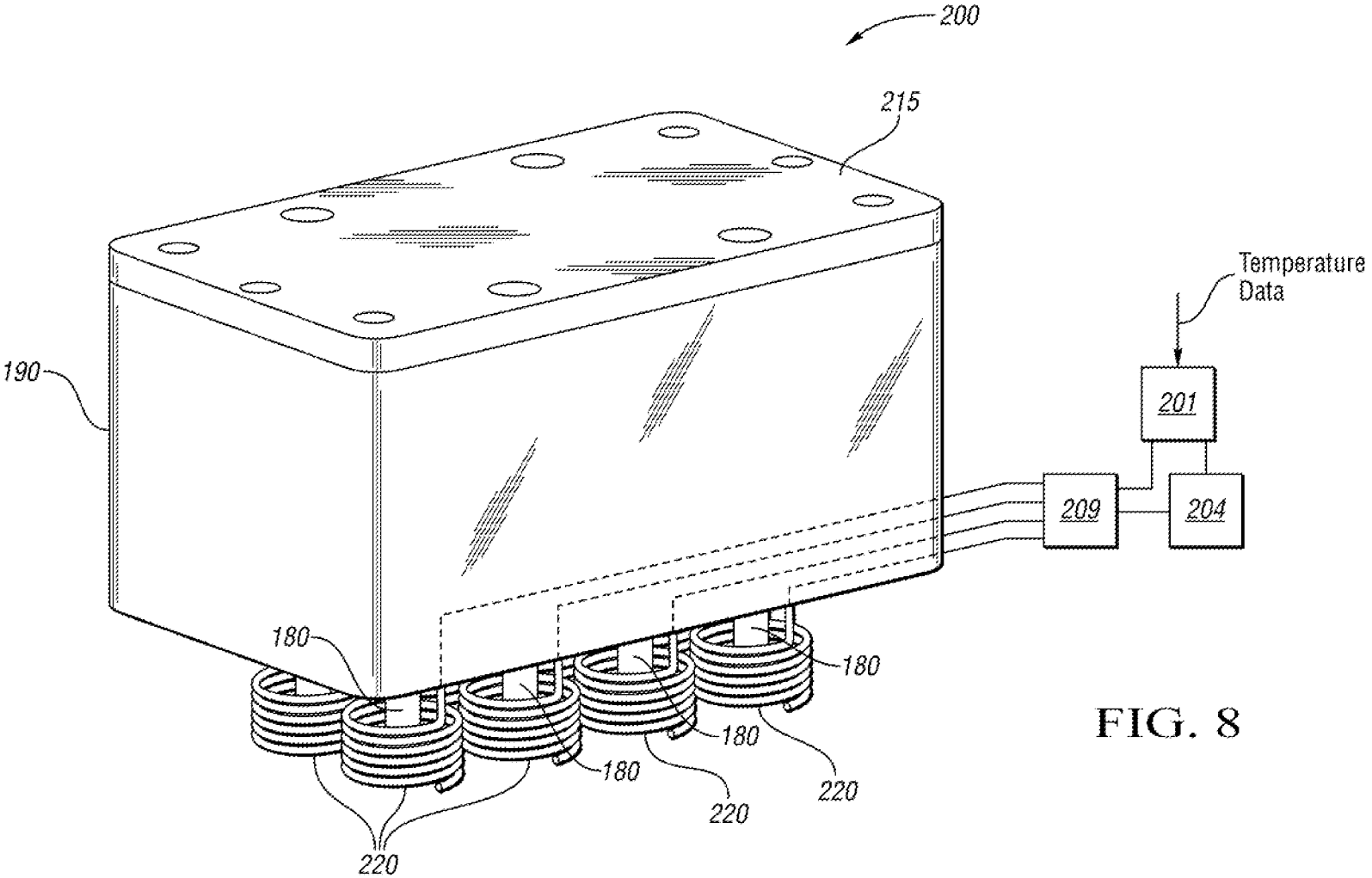
FIG. 8 is a schematic illustration in perspective view of a parallel upper punch assembly of the apparatus of FIG. 1 showing a control system for activating inductive heating mechanisms included in the apparatus of FIG. 1.

Referring to FIG. 8, after the parallel upper punch assembly 200 is in position and during loading or after the desired loading has been achieved, in step 310 heating mechanisms are activated. In this embodiment, the heating mechanisms are heater coils 220. The coils 220 are induction heating mechanisms that work by heating an electrically conducting object through electromagnetic induction. In both embodiments of the load transferring mechanism 15, 15A, the induction heater coils 220 are electromagnets through which high frequency alternating current (AC current) is passed, as powered by a power source 204 through a power circuit 209 under the control of a controller 201. This generates eddy currents in the conducting object, leading to Joule heating of the object. Accordingly, if the powder material samples 150A, 150B, 150C or 150D are electrically-conductive materials, then they can be heated by the induction heater coils 220. When the powder material sample 150A, 150B, 150C or 150D is electrically-conductive, then the components that come into contact with the powder material sample 150A, 150B, 150C or 150D (parallel die 70, lower punch 110, and upper punch 180) should be made of a nonconductive material, such as ceramic, in order to ensure optimum heating of the powder material sample 150A-150D. For example, the punch support plate 90 and the punch retaining plate 100 could be made out of a thermally-insulating material such as ceramic to ensure good thermal isolation of each opening 140 and the powder material samples 150A-150D within the pockets 135. The parallel die 70 may also be made of a thermally-insulating material or thermal breaks can be located around each opening 140. As shown in FIG. 5, thermal breaks 202 are located around each opening 140 in the die 70 to isolate the heating of the different material samples 150A-105D. Each thermal break 202 may be a cylindrical sleeve of a thermally-insulating (nonconductive) material.

In contrast, if the powder material samples 150A, 150B, 150C or 150D to be pressed are nonconductive, then the components that come into contact with the powder material sample 150A, 150B, 150C or 150D (parallel die 70, lower punch 110, and upper punch 180) must be made of a conductive material such as steel. Because nonconductive powder material samples 150A, 150B, 150C or 150D cannot be inductively heated directly, the die components in direct contact with the powder material sample 150A, 150B, 150C or 150D are heated inductively. Heat is transferred from the die components (parallel die 70, lower punch 110, and upper punch 180) to the material sample 150A, 150B, 150C or 150D as it is being compressed. The thermal breaks 202 would be used in such an embodiment.

The powder material samples 150A, 150B, 150C and 150D are thus held under pressure and heated simultaneously. This has been found to improve the densification process. The load (and corresponding pressure) and temperature can be adjusted depending on the requirements of the material sample. For example, to achieve 99% density of a 50 μm tool steel powder in one hour, a pressure of approximately 50 MPa and a first temperature of approximately 1200° C. are required. These parameters may be applied to a first material sample 150A using a first induction heating mechanism (coil 220), while a second powder material sample 150B can be heated to a second temperature of 800° C., for example, using a second induction heating mechanism (coil 220 aligned with powder material sample 150B). The controller 201 receives temperature data from temperature sensors (not shown) positioned in thermal communication with the pockets 135 of FIG. 5 and controls the current to the coils based on the temperature data to achieve the first and second temperatures. Alternatively or in addition, the powder material samples 150A, 150B can be heated at different rates or for different periods of time.

As the powder material sample 150A, 150B, 150C or 150D is densified, the sample 150A, 150B, 150C or 150D will take up less volume. The independent spring loading of each upper punch 180 by a corresponding aligned one of the stacks of wave springs 210 allows each powder material sample 150A-150D to stay under a relatively constant pressure (determined by the spring rate of the corresponding stack of wave springs 210).

After densification is complete, hydraulic pressure applied to the hydraulic cylinder 30 is relieved so that the hydraulic cylinder 30 is retracted and the apparatus 10 for parallel uniaxial hot pressing returns to the open position of FIG. 6. At this point, the densified samples formed from samples 150A-150D can be removed from the apparatus 10 and used for testing.

Figure 12:
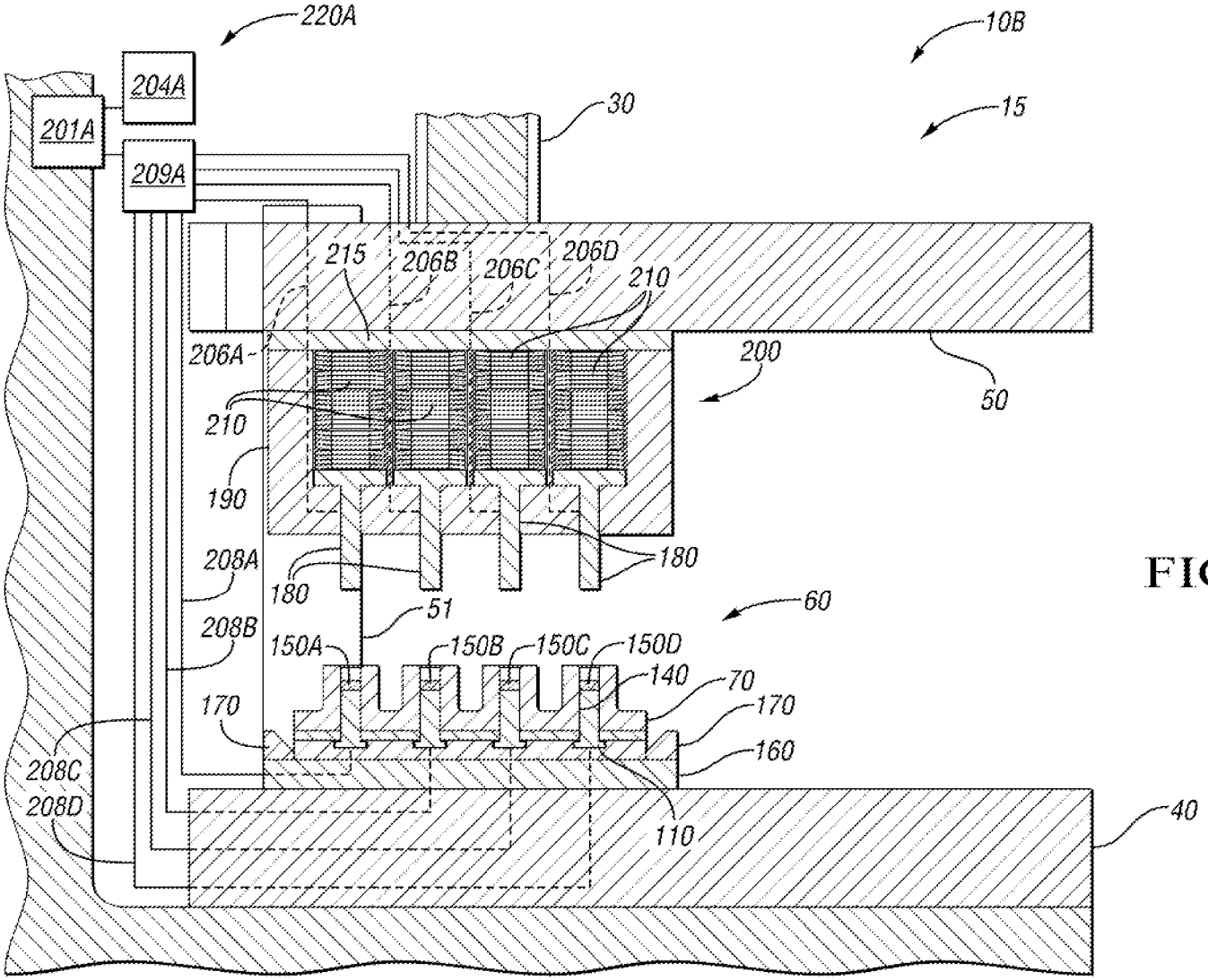
FIG. 12 is a schematic cross-sectional illustration of an alternative embodiment of an apparatus for parallel uniaxial hot pressing having a potential voltage difference between upper and lower punches for generating heat in the material samples.

FIG. 12 shows another embodiment of an apparatus 10B alike in all aspects to the apparatus 10 of FIG. 7 except that consolidation is achieved by Spark Plasma Sintering (SPS) using a heating mechanism 220A that is configured to create a potential voltage difference between the upper punches 180 and the lower punches 110 so that current is applied to the material samples 150A-150D when the punches 180 are lowered into contact with the material samples 150A-150D.

The heating mechanism 220A includes a power source 204A and positive leads 206A, 206B, 206C, 206D operatively connected to the different upper punches 180, as well as negative leads 208A, 208B, 208C, 208D operatively connected to the different lower punches 110. A power circuit 209A is configured to enable different potential voltage differences to be established at the different pairs of upper punches 180 and lower punches 110 so that the currents and ultimately the heating of each of the material samples 150A, 150B, 150C, 150D is independent of the heating of the other material samples 150A, 150B, 150C, 150D. Alternatively, the power circuit 209A could be controlled to provide the same potential voltage difference to each of the material samples 150A-150D.

The apparatus 10B is operable according to the same method 300 of FIG. 11 as described above. Step 310 of the method, activating the heating mechanisms, is accomplished by a controller 201A controlling the power circuit 209A to provide the desired potential differences to the material samples 150A, 150B, 150C, 150D, rather than by heating the inductive coils 220 as in the embodiment of FIG. 7.

While the best modes for carrying out the invention have been described in detail, those familiar with the art to which this invention relates will recognize various alternative designs and embodiments for practicing the invention within the scope of the appended claims.

The invention claimed is:

1. An apparatus comprising:

a die assembly defining multiple pockets;

a load transferring mechanism selectively providing a respective uniaxial compressive load at each of the pockets;

multiple heating mechanisms arranged so that each of the pockets is aligned with a different respective one of the heating mechanisms, the load transferring mechanism and the heating mechanisms thereby providing both compressive loading and heating of multiple material samples in parallel when material samples are in the pockets;

wherein the load transferring mechanism includes multiple biasing mechanisms configured to provide resistance to compression and arranged so that each of the pockets is aligned with a different respective one of the multiple biasing mechanisms; and wherein at least some of the multiple biasing mechanisms are stacks of wave springs including a first stack of wave springs at a first of the pockets and a second stack of wave springs at a second of the pockets.

2. The apparatus of claim 1, wherein the load transferring mechanism is configured so that the respective uniaxial compressive load at the first of the pockets is different from the respective uniaxial compressive load at the second of the pockets.

3. The apparatus of claim 1, wherein the first stack of wave springs has a first stiffness and wherein the second stack of wave springs has a second stiffness different than the first stiffness.

4. The apparatus of claim 1, wherein the load transferring mechanism includes multiple hydraulic cylinders arranged so that each of the pockets is aligned with a different respective one of the multiple hydraulic cylinders; and a hydraulic control system operable to provide different hydraulic pressures to different ones of the multiple hydraulic cylinders, thereby providing different compressive loads at different ones of the pockets.

5. The apparatus of claim 1, wherein the heating mechanisms include coils for inductive heating, and further comprising:

a power source configured to selectively provide alternating current to each of the coils; and a controller configured to provide alternating current to a first of the coils until a first temperature is reached in a material sample in a first of the pockets and to provide alternating current to a second of the coils until a second temperature different than the first temperature is reached in a material sample in a second of the pockets, temperature of the respective material samples in the pockets thereby being individually controllable.

6. An apparatus of comprising:

a die assembly defining multiple pockets;

a load transferring mechanism selectively providing a respective uniaxial compressive load at each of the pockets;

multiple heating mechanisms arranged so that each of the pockets is aligned with a different respective one of the heating mechanisms, the load transferring mechanism and the heating mechanisms thereby providing both compressive loading and heating of multiple material samples in parallel when material samples are in the pockets;

wherein the die assembly includes a punch assembly with upper and lower punches arranged so that the sockets are defined between the us ser and lower punches;

wherein the heating mechanisms include a power source and lead wires operatively connecting the upper and lower punches to the power source to establish respective independent potential differences between pairs of the upper and lower punches corresponding with the pockets;

wherein the heating mechanisms generate currents to heat the respective material samples when the upper punches are moved into contact with the material samples;

wherein the die assembly further includes:

a support plate with spaced recesses; wherein the lower punches are configured to fit within the spaced recesses;

a retaining plate with spaced openings configured to fit over the lower punches so that the retaining plate retains the lower punches in the spaced openings;

a die configured to fit over the lower punches and the retaining plate to thereby define the pockets above the lower punches; and wherein all of the die, the upper punches, and the lower punches are configured to be one of electrically-conductive and electrically-nonconductive for use with material samples in the pockets that are the other of electrically-conductive and electrically-nonconductive.

7. The apparatus of claim 6, further comprising:

a nonconductive sleeve in the die substantially surrounding one of the lower punches when the die is fit over the lower punches.

8. An apparatus comprising:

a die assembly defining multiple pockets;

a load transferring mechanism selectively providing a respective uniaxial compressive load at each of the pockets;

multiple heating mechanisms arranged so that each of the pockets is aligned with a different respective one of the heating mechanisms, the load transferring mechanism and the heating mechanisms thereby providing both compressive loading and heating of multiple material samples in parallel when material samples are in the pockets;

wherein the die assembly includes:

a support plate with spaced recesses;

punches configured to fit within the spaced recesses;

a retaining plate with spaced openings configured to fit over the punches so that the retaining plate retains the punches in the spaced openings;

a die configured to fit over the punches and the retaining plate to thereby define the pockets above the punches; and an additional plate having extension tabs spaced such that the retaining plate is nested on the additional plate between the extension tabs so that the pockets are aligned with the load transferring mechanism and the multiple heating mechanisms.

* * * * *